US007059359B2

(12) United States Patent
Quigley et al.

(10) Patent No.: US 7,059,359 B2
(45) Date of Patent: Jun. 13, 2006

(54) WARP BOUND COMPOSITE PAPERMAKING FABRIC

(75) Inventors: Scott D. Quigley, Townville, SC (US); James Brewster, Waskom, TX (US)

(73) Assignee: Voith Fabrics, Shreveport, LA (US)

( * ) Notice: Subject to any disclaimer, the term of this patent is extended or adjusted under 35 U.S.C. 154(b) by 325 days.

(21) Appl. No.: 10/443,474

(22) Filed: May 22, 2003

(65) Prior Publication Data

US 2004/0231745 A1 Nov. 25, 2004

(51) Int. Cl.
*D03D 11/00* (2006.01)

(52) U.S. Cl. ..... 139/383 A; 139/410; 162/348; 162/DIG. 1

(58) Field of Classification Search ..... 139/383 A, 139/410; 162/348, DIG. 1
See application file for complete search history.

(56) References Cited

U.S. PATENT DOCUMENTS

| | | | | |
|---|---|---|---|---|
| 2,934,097 | A | 4/1960 | Hindle et al. | 139/383 |
| 4,815,499 | A | 3/1989 | Johnson | 139/383 |
| 4,832,090 | A | 5/1989 | Krenkel | 139/383 |
| 4,867,206 | A | 9/1989 | Kufferath | 139/383 |
| 5,022,441 | A | 6/1991 | Tate | 139/383 |
| 5,152,326 | A * | 10/1992 | Vohringer | 139/383 A |
| 5,454,405 | A | 10/1995 | Hawes | 139/383 |
| 5,458,693 | A | 10/1995 | Codorniu | 139/383 |
| 5,544,678 | A | 8/1996 | Barrett | 139/383 |
| 5,713,397 | A | 2/1998 | Quigley | 139/383 |
| 5,826,627 | A | 10/1998 | Seabrook | 139/383 |
| 6,123,116 | A * | 9/2000 | Ward et al. | 139/383 A |
| 6,179,013 | B1 * | 1/2001 | Gulya | 139/383 A |
| 6,202,705 | B1 | 3/2001 | Johnson | 139/383 |
| 6,227,256 | B1 * | 5/2001 | Quigley | 139/383 A |
| 6,240,973 | B1 | 6/2001 | Stone | 139/383 |
| 6,244,306 | B1 * | 6/2001 | Troughton | 139/383 A |
| 6,334,467 | B1 | 1/2002 | Barrett | 139/383 |
| 6,413,377 | B1 * | 7/2002 | Wright | 139/383 A |
| 6,546,964 | B1 * | 4/2003 | Westerkamp | 139/383 A |
| 6,581,645 | B1 * | 6/2003 | Johnson et al. | 139/383 A |

* cited by examiner

*Primary Examiner*—John J. Calvert
*Assistant Examiner*—Robert H. Muromoto, Jr.
(74) *Attorney, Agent, or Firm*—McNair Law Firm, P.A.

(57) ABSTRACT

A composite papermaking fabric comprising an upper support fabric and a lower contact fabric. The upper fabric is formed of warp yarns, fabric born warp yarns and weft yarns interwoven to provide the upper fabric with a support surface forming a one up, one down weave.

The lower fabric is formed of the fabric born warp yarns interwoven with weft yarns in a weave pattern which provides a weft yarn dominated contact surface. Each of the fabric born warp yarns also weaves over at least one of the upper fabric weft yarns during each repeat of the weave pattern forming binding points which bind the upper and lower fabrics together.

8 Claims, 5 Drawing Sheets

WARP BOUND COMPOSITE PAPERMAKING FABRIC

BACKGROUND OF THE INVENTION

The present invention is directed to a composite papermaking fabric which is preferably used in the forming section but could also be used in the dryer section. The term composite fabric refers to a fabric comprising two woven structures one of which is the paper side fabric or upper fabric and the other of which is the machine side fabric or lower fabric. The paper side fabric includes a support surface which surface receives and supports the paper forming pulp during the paper forming operation. The lower or contact fabric separates the support fabric from the machine rollers during the paper forming operation and includes a roller contact or contact surface. Both fabrics must be stable and provide the required drainage. The support fabric must also provide an even support surface without unduly high knuckles or unduly deep knuckle depressions so as to not mark the paper during the paper forming operation.

The upper and lower fabrics are bound together with a binder yarn which in the instant case comprises fabric born or intrinsic warp yarns. The terms fabric born or intrinsic warp yarn indicates that the binder yarn while binding the upper and lower fabrics together also weaves in the machine direction with and is an integral part of the weave pattern of both the upper and lower fabrics. The term warp yam refers to yarns which weave in a single specified layer of the fabric and in the machine direction. The term weft yarn refers to yarns woven transverse of the warp yarns.

Composite papermaking fabrics are well known as are illustrated by the U.S. Pat. Nos. 5,152,326; 5,826,627; 6,202,705; and 6,240,973.

It is an object of the present invention to provide a composite papermaking fabric which provides uniform drainage, a smooth and even support surface and extended wear.

Another object of the invention is a papermaking fabric in which the support surface is formed in a one up, one down weave pattern.

Another object of the invention is a composite papermaking fabric in which fabric born or intrinsic warp yarns bind the upper and lower fabrics together and weave with weft yarns to form the lower fabric.

Another object of the invention is a composite papermaking fabric in which the weft yarn of the upper fabric at the binding points are supported against downward movement.

Another object of the invention is the provision of a composite papermaking fabric in which no pairing of weft yarns appear on either surface.

Another object of the invention is the provision of a composite papermaking fabric in which no pairing of warp and fabric born or intrinsic warp yarns appear on either surface.

SUMMARY OF THE INVENTION

The present invention is directed to a composite papermaking fabric having an upper fabric which includes a fiber support surface and is formed of warp yarns, fabric born or intrinsic warp yarns and weft yarns. The support surface is woven in a one up, one down weave pattern. The papermaking fabric also includes a lower fabric formed of fabric born or intrinsic warp yarns and weft yarns interwoven to provide a weft yarn dominated contact surface. Each fabric born warp or intrinsic yarn is controlled to weave over at least one of the upper fabric weft yarns during each repeat of the weave pattern forming binding points which act to bind the upper fabric with the lower fabric.

The preferred weave pattern requires that each fabric born or intrinsic warp yarn weave over two of the upper weft yarns to form two binding points which are spaced longitudinally of the weave pattern. The binding points form a broken twill line across the weave pattern and the width of the papermaking fabric.

To insure that the support surface is even and smooth, the upper warp yarns float beneath the upper weft yarns at each of the binding points forming a support beneath the upper weft yarns which acts to maintain knuckle height uniform across the support surface. The fabric born or intrinsic warp yarns weave with the weft yarns of the lower fabric in a broken twill pattern forming a plurality of even weft floats on the contact surface. There is a plurality of the weft yarn floats formed by each lower weft yarn per weave pattern repeat.

A composite papermaking fabric comprising an upper fabric formed with a support surface woven in a one up, one down weave pattern and a lower fabric formed with a weft dominated contact surface. The papermaking fabric comprises a plurality of warp yarns weaving with upper weft yarns in a selected first weave pattern and a plurality of fabric born or intrinsic warp yarns weaving with lower weft yarns in a selected second weave pattern forming the lower fabric and weaving with the upper weft yarns in the second selected weave pattern to cross over the upper weft yarns at selected locations forming binding knuckles. The fabric born or intrinsic warp yarns at the binding knuckles bind the upper fabric with the tower fabric. The binding knuckles cooperate with the knuckles of the warp yarns weaving in the first weave pattern to form the support surface in a one up, one down weave pattern.

The warp yarns weave beneath each of the upper weft yarn at the selected locations forming the binding knuckles providing support beneath the upper weft yarn and the binding knuckle which support assists in maintaining the binding knuckles parallel with the remainder of the knuckles of the support surface.

The weft yarn weaving with the fabric born or intrinsic warp yarns form the contact surface with two floats on the contact surface per pick throughout a weave pattern repeat.

DRAWINGS

DETAILED DESCRIPTION

Figure 1:
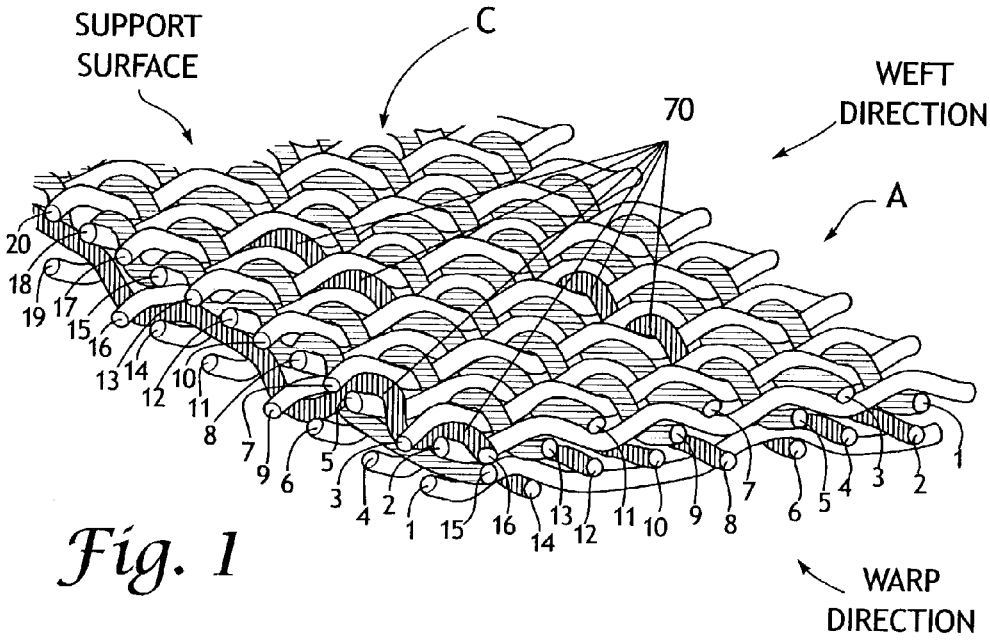
FIG. 1 is a cutaway perspective view showing the support surface of the papermaking fabric through a portion of the weave pattern.
Figure 2:
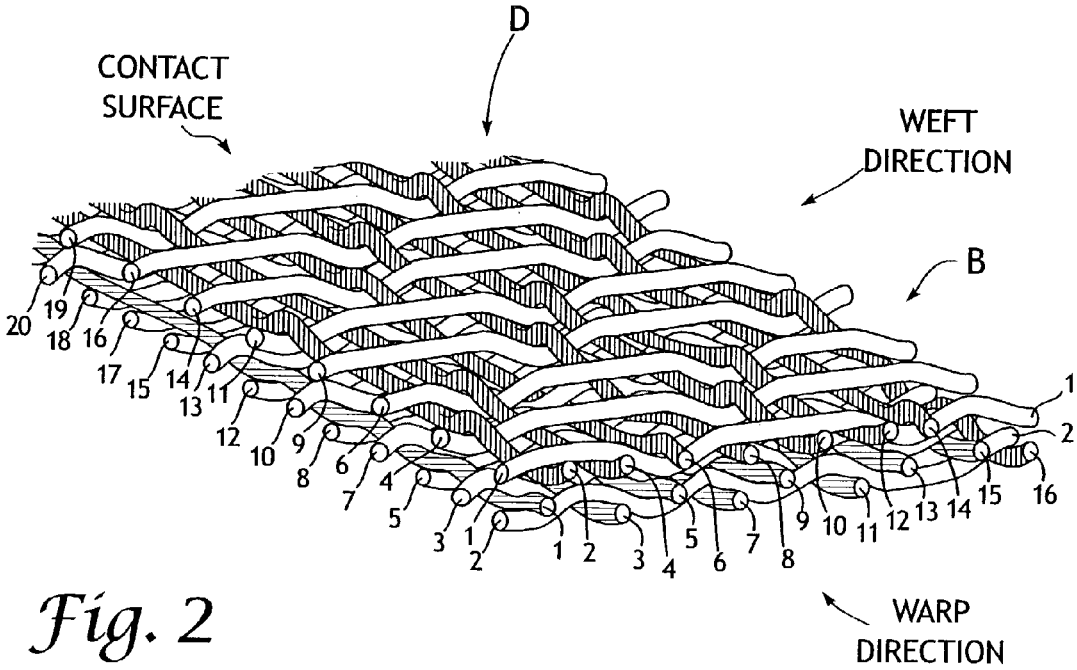
FIG. 2 is a cutaway perspective view showing the contact surface of the papermaking fabric through a portion of the weave pattern.
Figure 3:
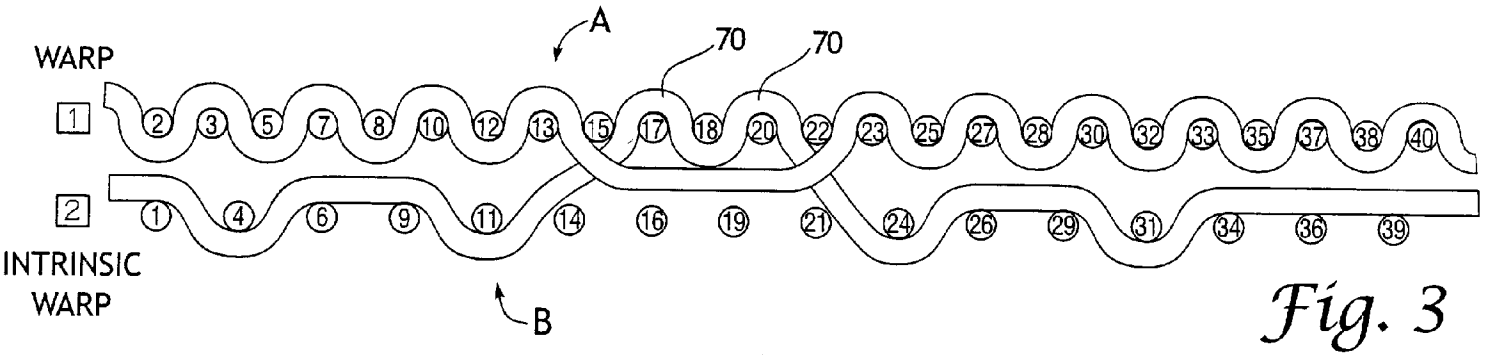
FIG. 3 is a side view showing the relationship of warp yarn 1 and fabric born or intrinsic warp yarn 2 with all of the weft yarns through the weave pattern.
Figure 4:
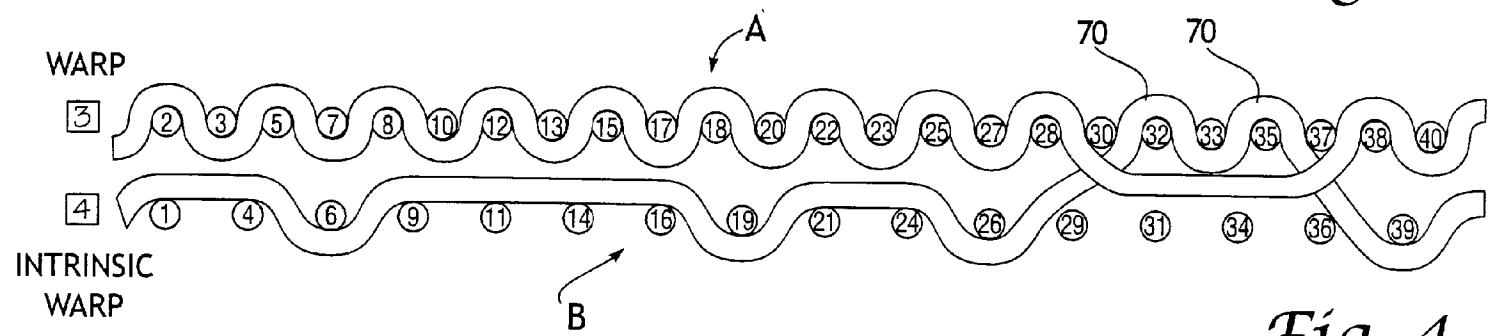
FIG. 4 is similar to FIG. 3 showing the relationship of warp yarn 3 and fabric born or intrinsic warp yarn 4 with the weft yarns through the weave pattern.
Figure 5:
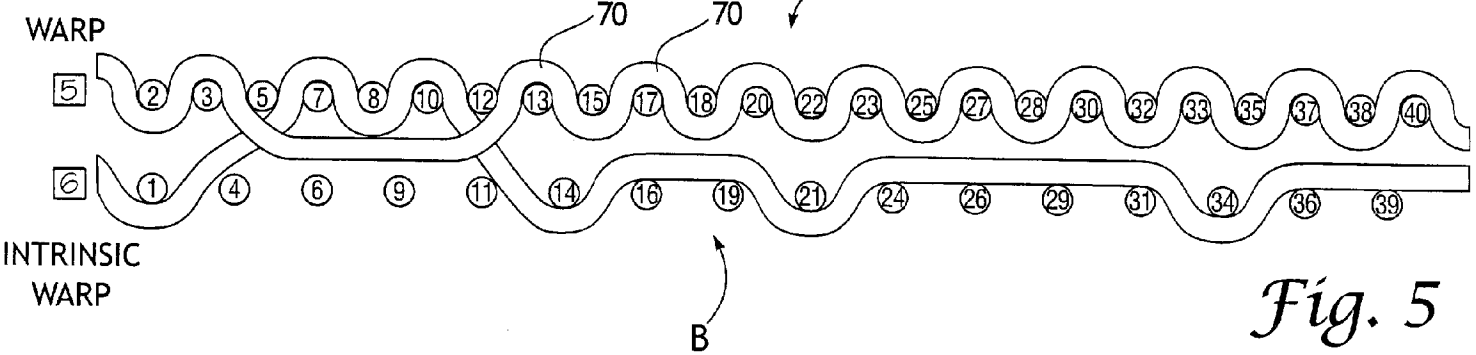
FIG. 5 is similar to FIG. 3 showing the relationship of warp yarn 5 and fabric born or intrinsic warp yarn 6 with the weft yarns through the weave pattern.
Figure 6:
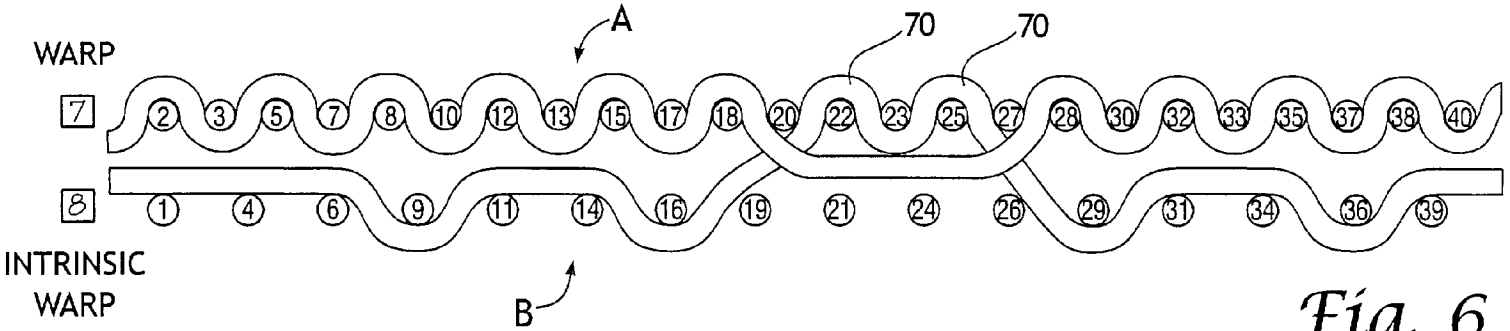
FIG. 6 is similar to FIG. 3 showing the relationship of warp yarn 7 and fabric born or intrinsic warp yarn 8 with the weft yarns through the weave pattern.
Figure 7:
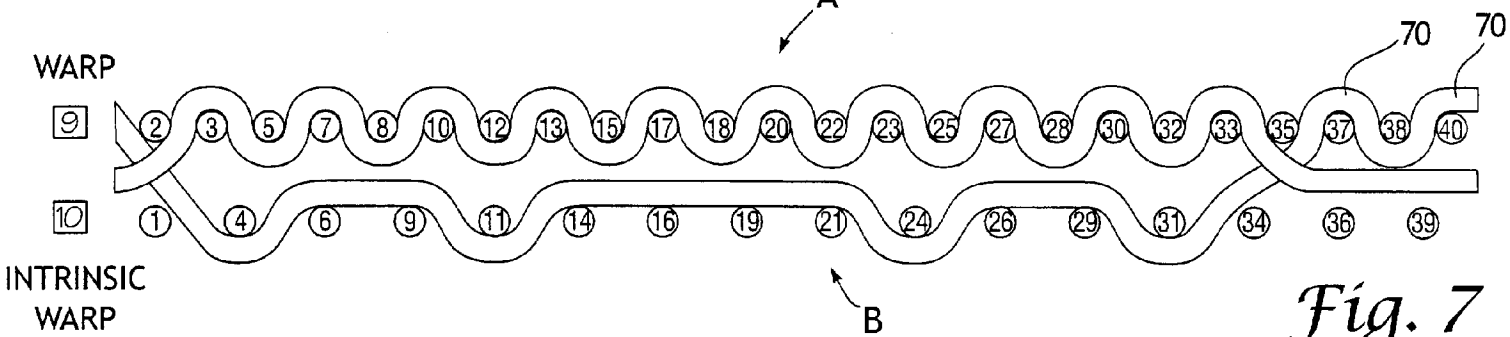
FIG. 7 is similar to FIG. 3 showing the relationship of warp yarn 9 and fabric born or intrinsic warp yarn 10 with the weft yarns through the weave pattern.
Figure 8:
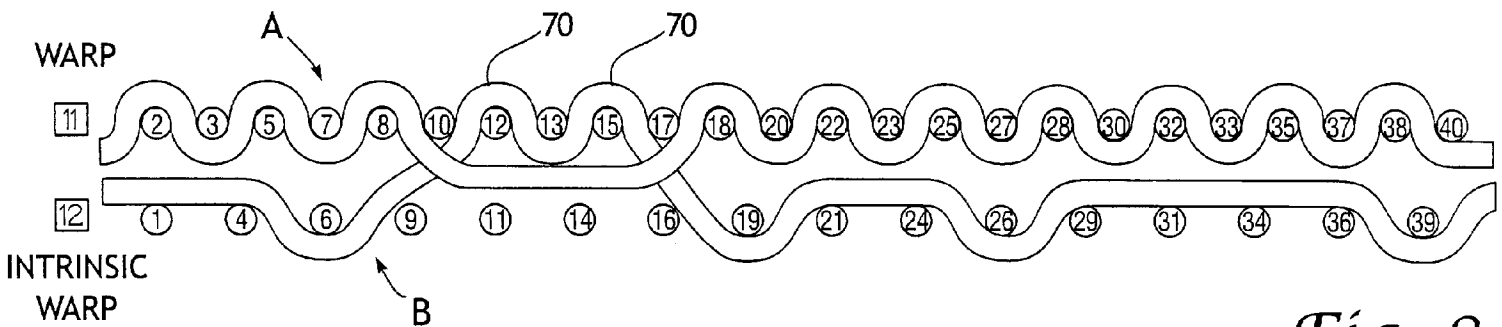
FIG. 8 is similar to FIG. 3 showing the relationship of warp yarn 11 arid fabric born or intrinsic warp yarn 12 with the weft yarns through the weave pattern.
Figure 9:
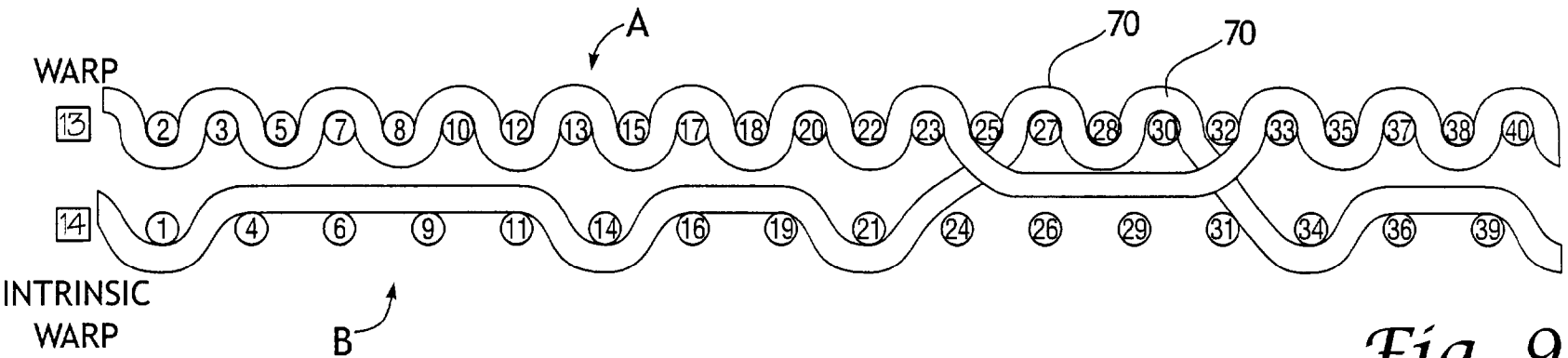
FIG. 9 is similar to FIG. 3 showing the relationship of warp yarn 13 and fabric born or intrinsic warp yarn 14 with the weft yarns through the weave pattern.
Figure 10:
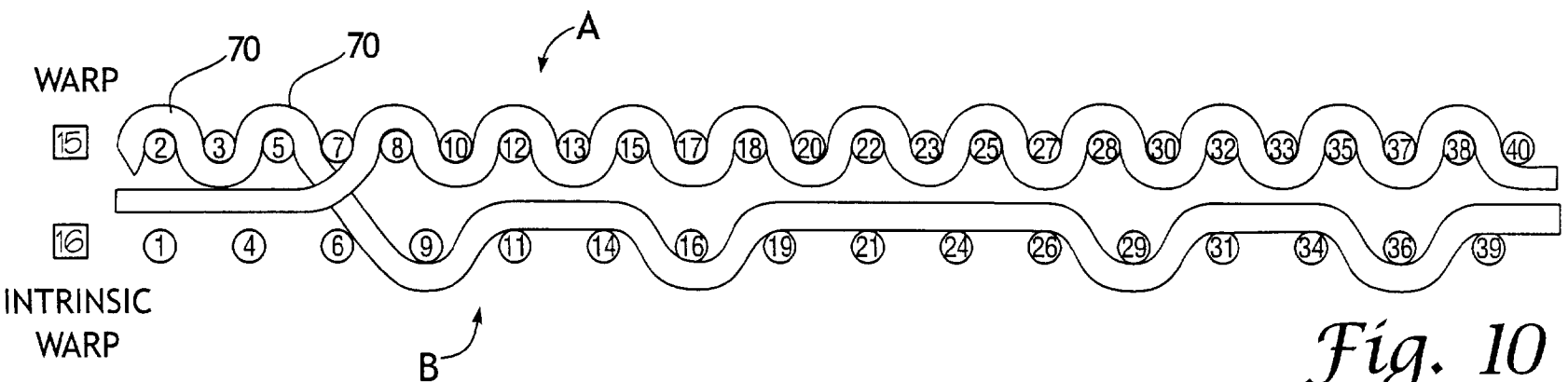
FIG. 10 is similar to FIG. 3 showing the relationship of warp yarn 15 and fabric born or intrinsic warp yarn 16 with the weft yarns through the weave pattern.
Figure 11:
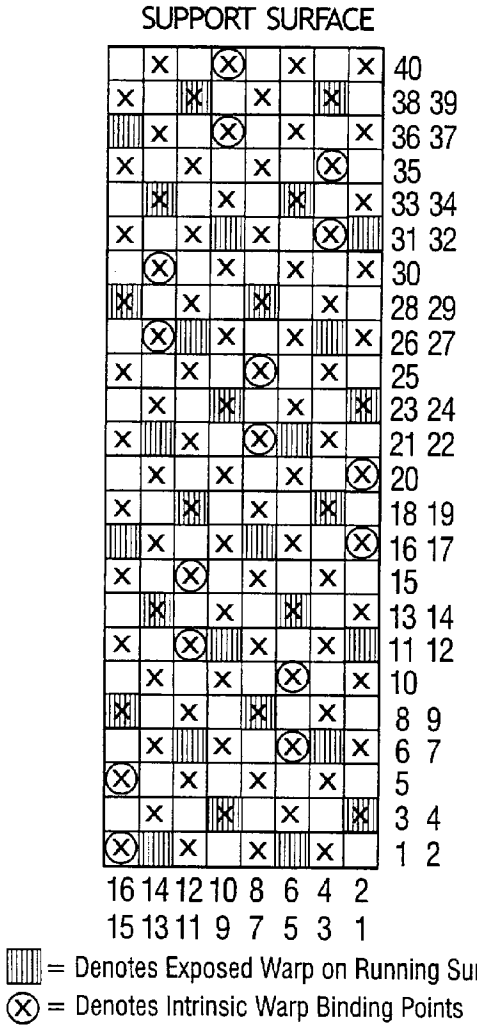
FIG. 11 is a diagram of the weave pattern of the support surface.

Turning now to the drawings FIGS. 1 and 2 represent sectional perspective views of the composite papermaking in which the upper fabric A is formed with a paper pulp support surface C as shown in FIG. 1 and the lower contact fabric B which is formed with a lower roller contact surface D as shown in FIG. 2. As shown in FIG. 1 and further illustrated in FIG. 11, upper fabric A and more specifically, support surface C is woven in a one up, one down weave pattern allowing the support surface to present an even array of warp knuckles separated on each side by a weft knuckle. This is best illustrated in FIG. 11 where each X represents a warp yarn passing over a weft yarn on the support surface. Each passover forms a warp knuckle. Likewise, each weft yarn passing over a warp yarn on the support surface is represented by a blank square. These passovers form weft knuckles. Each X represents a binding point where the warp yarn passing over the weft yarn is an fabric born or intrinsic warp yarn.

The upper fabric A is woven utilizing eight warp yarns numbered 2, 4, 6, 8, 10, 12 & 16 and with eight fabric born or intrinsic warp yarns numbered 1, 3, 5, 7, 9, 11, 13 & 15 per weave pattern repeat. The warp yarns and the fabric born warp yarns are arranged in pairs, i.e. fabric born warp yarn 1 and warp yarn 2, fabric born warp yarn 3 and warp yarn 4, etc. The weave pattern repeat also weaves with forty weft yarns numbered 1–40. Weft yarns 2, 3, 5, 7, 8, 10, 11, 12, 13, 15, 17, 18, 20, 22, 23, 25, 27, 28, 30, 32, 33, 36, 37, 38 & 40 weave with the warp yarns and the fabric born or intrinsic warp yarns to form the upper or support fabric A. Weft yarns 1, 4, 6, 9, 11, 14, 16, 19, 21, 24, 26, 29, 31, 34, 36 & 39 weave only with the fabric born or intrinsic warp yarn to form lower or contact fabric B.

Again turning to FIGS. 1, 2, 11 & 12. In FIGS. 1 & 11, the x represents the binding points or the positions in which a fabric born or intrinsic warp yarn passes over an upper weft yarn weaving with the support fabric A to bind the support fabric A with the contact fabric B forming the composite fabric. These binding points, which form binding knuckles 70, are identified in FIGS. 1 and 3–10.

FIGS. 3–10 are side views of each of the warp and fabric born or intrinsic warp yarns weaving with the weft yarns 1–40 through a complete repeat of the weave pattern. As is clearly shown, warp yarns 1, 3, 5, 7, 9, 11, 13 & 15 weave only with weft yarns 2, 3, 5, 7, 8, 10, 12, 13, 15, 17, 18, 20, 22, 23, 25, 27, 28, 30, 32, 33, 35, 37, 38 & 40 forming support fabric A. The weave pattern at selected points brings the upper warp yarns to float beneath five consecutive of the upper weft yarn picks, such as warp yarn 1 at the pick of weft yarns 15, 17, 18, 20 & 22 in FIG. 3 and warp yarn 5 at the pick of weft yarns 5, 7, 8,10 and 12 in FIG. 5. It is along these floats that the fabric born warp or intrinsic yarns are brought up to pass over two spaced picks, such as fabric born or intrinsic warp yarn 2 over picks 17 & 20 in FIG. 3 and fabric born warp yarn 6 over picks 7 and 10 in FIG. 5, binding upper fabric A with lower fabric B. Throughout the remainder of the weave pattern, each of the fabric born or intrinsic warp yarns weaves with selected of the upper weft yarns securing support fabric A with contact fabric B at the binding points illustrated in FIG. 11 along each fabric born or intrinsic warp yarn. The binding points form a broken twill pattern over the support surface.

Again, as seen in FIGS. 1 & 3–10 at each binding point 70, the associated upper warp yarn passes beneath the pick where the binding point is formed with the fabric born or intrinsic warp yarn. In the above referred to example , warp 1 passes beneath weft yarn or picks 17 & 20 at binding points 70. Likewise in FIG. 5 warp yarn or pick 5 passes beneath weft yarns 7 & 10 at binding point 70. By so controlling the upper warp yarns to be positioned beneath the binding points 70 they function to support the weft yarns and thereby the binding knuckles against vertical downward movement. This vertical support acts to help maintain the crest of the knuckles formed at binding points 70 elevated and on an even and substantially parallel plane with the remainder of the knuckles forming the support surface C. Also, by passing the upper warp yarns beneath the upper weft at the binding points no adjacent knuckles appear on the support surface at the binding points.

Figure 12:
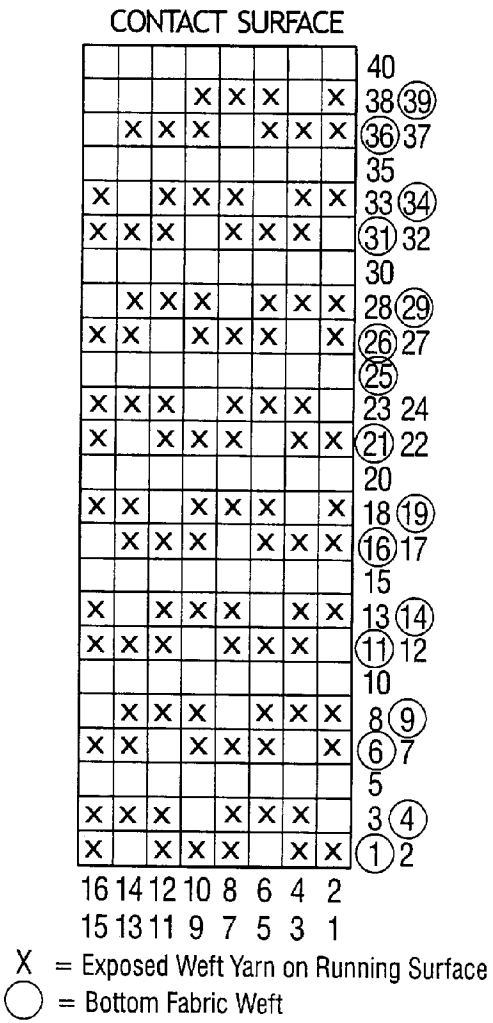
FIG. 12 is a diagram of the weave pattern of the contact surface.

Turning now to FIGS. 2–10 & 12 contact fabric B will now be discussed. As seen in FIGS. 2 & 12 contact fabric B Is woven in a broken twill pattern with each fabric born or intrinsic warp yarn passing beneath four weft yarns at spaced locations on contact surface D. Each fabric born or intrinsic warp yarn either floats above the lower weft yarns and beneath the warp and weft yarns of the upper or support fabric A or passes over the two of the upper picks forming binding points 70 throughout the remainder of each weave pattern as earlier discussed.

Turning again to FIGS. 2 & 12 it can be seen that the weave pattern forming lower fabric B produces a weft dominated contact surface D with each weft weaving with the lower fabric warp yarns to form two floats per pick throughout the weave pattern each of which passes beneath three warp yarns. This weave pattern forms a weft yarn dominated running or contact surface D.

The yarns selected for forming the disclosed fabric may comprise yarns of the same diameter or of varying diameters if desired. For example, it may be desirable to weave the support fabric with weft yarns of less size than the weft yarns forming the contact fabric. The warp and the fabric born or intrinsic warp yarns preferably are of the same size. Variation in yarn size may be selected depending upon the performance requirements.

The materials chosen for the yarns can vary depending upon the performance needs of the formed papermaking fabric. Generally stability is of the utmost importance, it being desired that the drainage capability be maintained throughout the life of the papermaking fabric. Also, wearability is another vital factor due to cost. Accordingly, polyester yarns which exhibit excellent stability characteristics may be selected to form the support surface and as the fabric born or intrinsic warp yarns. The running or contact surface weft yarns may be polyamide yarns due to greater wearability characteristics. Also, the contact side weft yarns may be of a larger diameter than the support fabric weft yarns. Other synthetic materials and size combinations may be selected to form the warp, weft, and fabric born warp yarns of the invention dependent upon the required performance needs of the fabric.

While a preferred embodiment of the invention has been described using specific terms, such description is for illustrative purposes only, and it is to be understood that changes and variations may be made without departing from the spirit or scope of the following claims.

What is claimed is:

1. A composite papermaking fabric comprising:

an upper fabric formed of warp yarns, fabric born warp yarns and upper weft yarns interwoven to provide a support surface formed in a one up, one down weave pattern;

a lower fabric formed of said fabric born warp yarns and lower weft yarns interwoven to provide a weft yarn dominated contact surface;

each said fabric born warp yarns weaving over a plurality of said upper fabric weft yarns during each repeat of said weave pattern forming binding points which bind said upper fabric with said lower fabric; and said warp yarns passing beneath each of said upper weft yarns forming said binding points and above each of said lower weft yarns beneath each of said binding points providing vertical support for said upper weft yarns at said binding points maintaining knuckle height uniform across said support surface.

2. The composite papermaking fabric of claim 1 wherein each said fabric born warp yarn weaves over two of said upper weft yarns during each repeat of said weave pattern forming two binding points spaced longitudinally of said weave pattern.

3. The composite papermaking fabric of claim 1 wherein said binding points form a broken twill line across said weave pattern.

4. The composite papermaking fabric of claim 1 wherein said fabric born warp yarns weave with said weft yarns of said lower fabric in a broken twill pattern forming a plurality of weft yarns float on the contact surface.

5. The composite papermaking fabric of claim 4 wherein there are a plurality of said weft floats per pick per weave pattern repeat.

6. The composite papermaking fabric of claim 1 wherein said weave pattern comprises eight of said warp yarns, eight of said fabric born warp yarns and forty of said weft yarns per wave pattern repeat.

7. A composite papermaking fabric comprising:

a lower fabric woven in a twill weave pattern utilizing only fabric born warp yarns and lower weft yarns forming knuckles over a contact surface;

an upper fabric woven in a one up one down weave pattern utilizing upper weft yarns, warp yarns and said fabric born warp yarns forming a support surface of knuckles along a uniform plane;

said support surface knuckles formed by crossovers of said fabric born warp yarn over said upper weft yarn comprise binding points securing said upper and lower fabrics together; and said warp yarns passing over said lower weft yarns beneath each of said binding points providing support for said binding point knuckles against downward movement maintaining said knuckles along said uniform plane.

8. A composite papermaking fabric comprising:

an upper fabric formed of warp yarns, fabric born warp yarns and weft yarns interwoven to provide a support surface formed in a one up, one down weave pattern;

a lower fabric formed of fabric born warp yarns and weft yarns interwoven to provide a weft yarn dominated contact surface;

each said fabric born warp yarn weaving over at least one of said upper fabric weft yarns during each repeat of said weave pattern forming binding points binding said upper fabric with said lower fabric;

said warp yarns and said fabric born warp yarns being grouped in pairs each of which consist of a warp yarn and a fabric born warp yarn; wherein said warp yarn of each of said pairs floats beneath consecutive upper weft yarns when said fabric born warp yarn of each of said pairs forms a binding point.

* * * * *